US006198827B1

(12) United States Patent
Waller, Jr.

(10) Patent No.: US 6,198,827 B1
(45) **Date of Patent: *Mar. 6, 2001**

(54) 5-2-5 MATRIX SYSTEM

(75) Inventor: James K. Waller, Jr., Clarkston, MI (US)

(73) Assignee: Rocktron Corporation, Rochester Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/097,466

(22) Filed: Jun. 15, 1998

Related U.S. Application Data

(63) Continuation of application No. 08/769,459, filed on Dec. 18, 1996, now Pat. No. 5,771,295.
(60) Provisional application No. 60/009,229, filed on Dec. 26, 1995.

(51) Int. Cl.[7] ..... H04R 5/00
(52) U.S. Cl. ..... 381/18; 381/22; 381/23
(58) Field of Search ..... 381/1, 17, 22, 381/23, 120

(56) References Cited

U.S. PATENT DOCUMENTS 4,704,728 11/1987 Scheiber ..... 381/22
5,109,415 * 4/1992 Ishida ..... 381/1
5,155,770 * 10/1992 Maejima ..... 381/22
5,428,687 6/1995 Willcocks et al. ..... 361/18
5,771,295 * 6/1998 Waller, Jr. ..... 381/22

FOREIGN PATENT DOCUMENTS 0 260 753 3/1988 (EP) .
59-66300 * 4/1984 (JP) ..... 381/1
92 15180 9/1992 (WO) .

* cited by examiner

*Primary Examiner*—Forester W. Isen
*Assistant Examiner*—Xu Mei
(74) *Attorney, Agent, or Firm*—Frank J. Catalano

(57) ABSTRACT

A matrix system encodes five discrete audio signals down to a two-channel stereo recording and decodes the recorded stereo signal into at least five stand alone, independent channels to allow placement of specific sounds at any one of 5 or more predetermined locations as individual, independent sound sources, thus producing a 5-2-5 matrix system. One embodiment of the system provides signals to left front, right front, center, left rear, and right rear speaker locations. The matrix system is compatible with all existing stereo materials and material encoded for use with other existing surround systems. Material specifically encoded for this system can be played back through any other existing decoding systems without producing undesirable results.

3 Claims, 6 Drawing Sheets

5-2-5 MATRIX SYSTEM

This application is a continuation of copending application number 08/769,452, Dec. 18, 1996; now U.S. Pat. No. 5,771,295, issued on Jun. 23, 1998, and claims the benefit of provisional application No. 60/009,229, Dec. 26, 1995.

BACKGROUND OF THE INVENTION

The present invention relates generally to audio sound systems and more specifically to audio sound systems which can decode from two-channel stereo into multi-channel sound, commonly referred to as "surround" sound.

Since Peter Scheiber's U.S. Pat. No. 3,632,886 issued in the 1960s, many patents have been issued regarding multi-dimensional sound systems. These systems are commonly known as 4-2-4 matrix systems, where four discrete audio signals are encoded into a two channel stereo signal. This encoded stereo signal can then be played through a decoder, which extracts the four encoded signals and feeds them to their intended speaker locations.

4-2-4 matrix designs were originally applied to the quadraphonic sound systems of the 1970s, but in recent years have become enormously popular for cinematic applications and, even more recently, home theater applications. Following the demise of quadraphonic sound, companies such as Dolby Laboratories adapted the matrix scheme to cinematic applications in an attempt to provide additional realism to feature films. The aforementioned Scheiber patent, as well as his subsequent patents U.S. Pat. Nos. 3,746,792 and 3,959,590, are the patents cited by Dolby Laboratories for the Dolby Surround™ system. Popular surround systems for cinematic and home theater applications typically provide discrete audio signals to four speaker locations—front left, front right, front center and rear surround. The rear surround environment is typically configured with at least two speakers, located to the left and right, which are each fed the mono surround signal.

Subsequent patents on 4-2-4 matrix systems have attempted to improve on the performance of the matrix. For example, the original passive systems were only capable of 3 dB of separation between adjacent channels (i.e. left-center, center-right, right-surround and surround-left), therefore it was desirable to develop a steered system which incorporated gain control and steering logic to enhance the perceived separation between channels.

Many prior art surround systems have utilized a variable matrix for decoding a given signal into multi-channel outputs. Such a system is disclosed in U.S. Pat. No. 4,799,260, assigned to Dolby Laboratories, as well as in U.S. Pat. No. 5,172,415 from Fosgate. Each of these patents disclose a variable output matrix which provides the final outputs for the system. Other designs, such as that shown in U.S. Pat. No. 4,589,129 from David Blackmer, disclose a system which does not include a variable output matrix but instead includes individual steering blocks for left, center, right and surround.

The evolution of the surround sound system has seen the developers of such systems progressively attempt to develop the technology which would allow audio engineers the ability to place specific sounds at any desired location in the 360° soundfield surrounding the listener. A recent result of this can be seen with the development of Dolby Laboratories' AC3 system, which provides five discreet channels of audio. However, there are at least two major drawbacks to such a system: (1) it is not backward-compatible with all existing material, and, (2) it requires digital data storage—not allowing for analog recording of data (i.e. audio tape, video tape, etc.). A Dolby AC3-encoded digital soundtrack can not be played back through a Dolby Pro Logic system.

The inventions described in my U.S. Pat. Nos. 5,319,713 and 5,333,201 are major improvements over what has become commercially known and available as Dolby Surround™ and Dolby Pro Logic™, primarily in that those patents cited describe a means of providing directional information to the rear channels—a feature which the Dolby systems do not provide. This feature is very desirable in exclusive audio applications, as well as in applications where audio is synched to video (A/V), and is fully described in the above-cited patents. However, although the inventions described in my above-cited patents greatly improve on the previous designs, none of the matrix-based systems disclosed to date have provided a means of achieving independent left and right rear channels when decoded.

My currently pending U.S. patent application Ser. No. 08/426,055 discloses a means of providing additional discrete signals through the practice of embedding one or more signaling tones at the upper edge of the audio spectrum during the encode process. These tones can then be detected during the decode process to re-configure the system such that front left, center and front right channels become disabled—thus allowing for signals panned left, center and right to be fed exclusively to the rear left, overhead and rear right locations, respectively. The detection of an additional signaling tone can then reset the system configuration, if desired. Although this system provides a means of producing additional channels and is an improvement to existing systems, it does introduce drawbacks. For example, the practice of embedding tones within the audio spectrum introduces the possibility of them becoming audible to the listener, which is unacceptable. In addition, such a system could only be applicable to a limited number of recording mediums, due to the inherent limitations of mediums such as cassette tape and the optical soundtrack for 35 mm film.

It is desirable, therefore, to be able to encode five discrete audio signals down to a two-channel stereo recording and then have the ability to place specific sounds at any one of 5 or more predetermined locations as individual, independent sound sources when decoded—thus producing a 5-2-5 matrix system. A typical implementation of such a system might provide signals to left front, right front, center, left rear, and right rear speaker locations. There are numerous other embodiments of the invention with many other possible channel configurations, as will be apparent to those skilled in the art. It is, therefore, a primary object of the present invention to provide a matrix system which would decode a stereo signal into at least five stand-alone, independent channels. It is also an object of the present invention to achieve a matrix system which is compatible with all existing stereo material. Another object of this invention is to provide a matrix system which is compatible with material encoded for use with other existing surround systems. Yet another object of this invention is to provide a matrix system such that material specifically encoded for this system can be played back through any other existing decoding systems without producing undesirable results.

SUMMARY OF THE INVENTION

In accordance with the invention, a matrix system is provided to encode five discrete audio signals down to a two-channel stereo recording and to decode the recorded stereo signal into at least five stand alone, independent channels to allow placement of specific sounds at any one of 5 or more predetermined locations as individual, independent sound sources, thus producing a 5-2-5 matrix system. One embodiment of the system provides signals to left front, right front, center, left rear, and right rear speaker locations. The matrix system is compatible with all existing stereo materials and material encoded for use with other existing surround systems. Material specifically encoded for this system can be played back through any other existing decoding systems without producing undesirable results.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
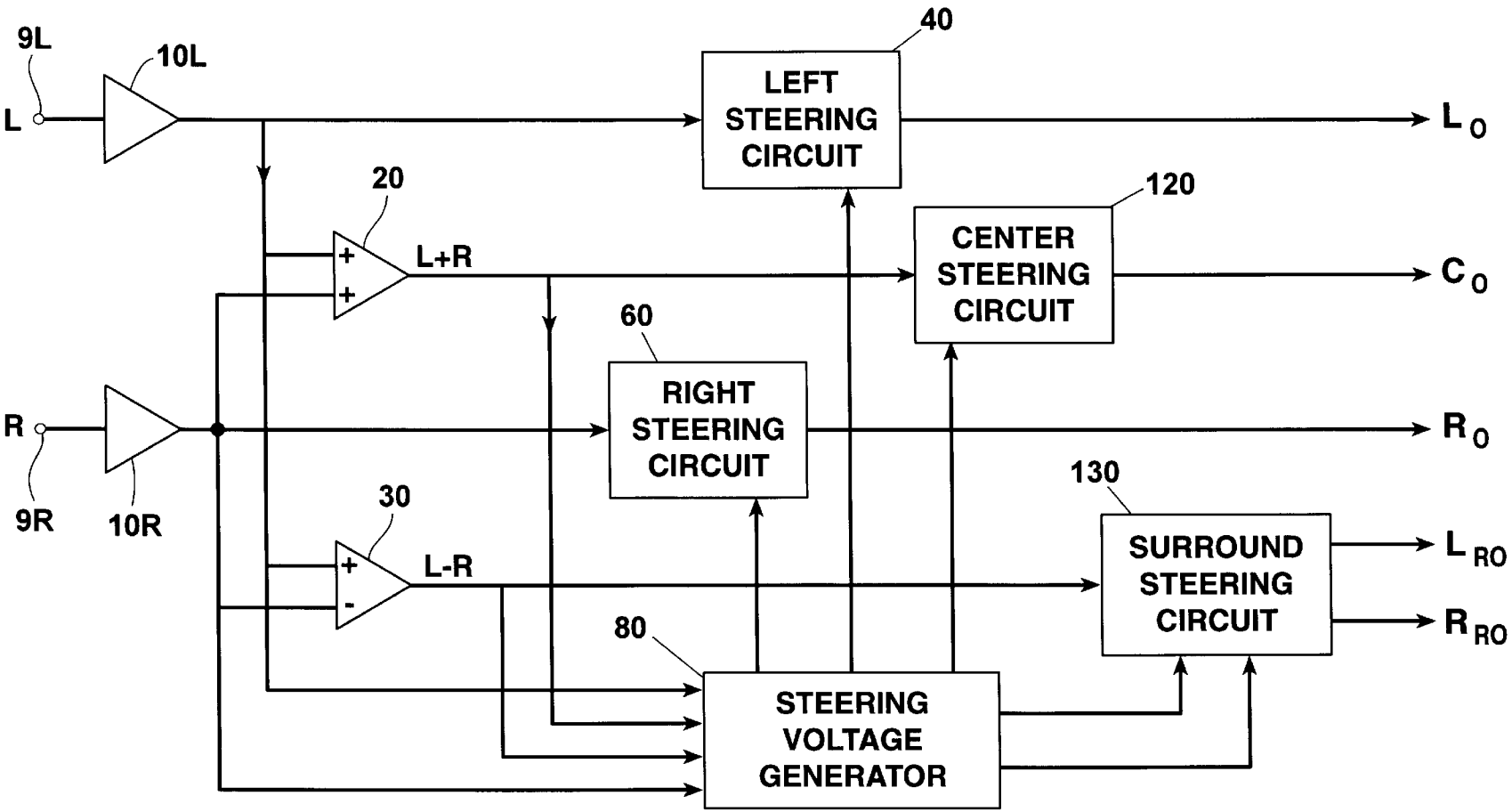
FIG. 1 is a block diagram of a preferred embodiment of the present invention.

Referring to FIG. 1, a fully implemented surround system is shown in which a left input signal is applied to an input node 9L. This input signal is buffered by an amplifier 10L and fed to a Left Steering Circuit 40 which provides the left front output $L_O$, as well as to a summing amplifier 20, a difference amplifier 30 and a Steering Voltage Generator 80. A right input signal is fed to input node 9R which is buffered by an amplifier 10R and fed to a Right Steering Circuit 60 which provides the right front output $R_O$, and to a summing amplifier 20, a difference amplifier 30 and a Steering Voltage Generator 80. The signal output from the summing amplifier 20 is fed to a Center Steering Circuit 120, which then provides the center channel output $C_O$, while the signal output from the difference amplifier 30 is fed to the Surround Steering Circuit 130 which then provides the left and right rear outputs $L_{RO}$ and $R_{RO}$. Each of the steering circuits 40, 60, 120 and 130 are controlled by the Steering Voltage Generator 80.

Figure 2:
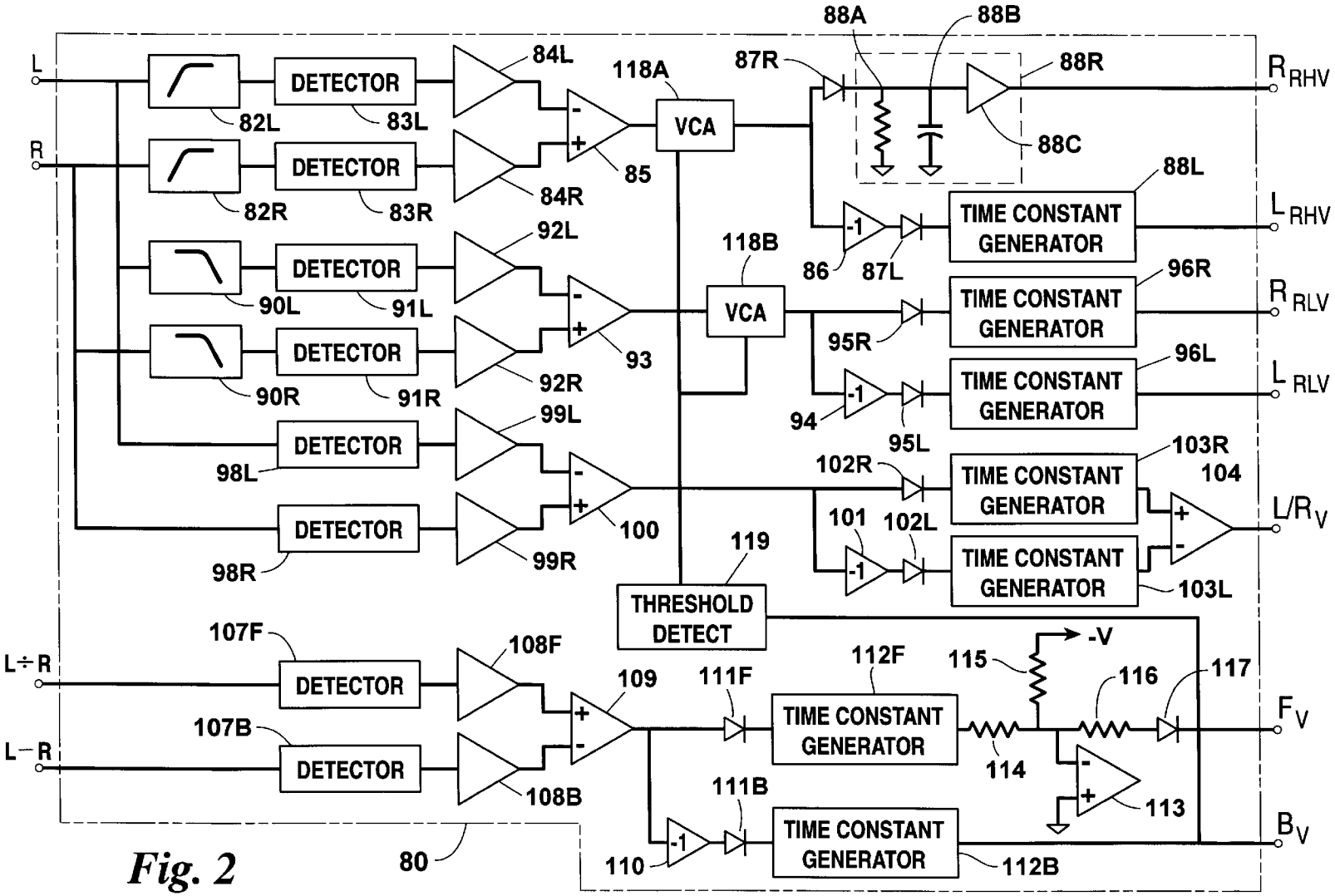
FIG. 2 is a partial block-partial schematic diagram of Steering Voltage Generator of FIG. 1.

Referring to FIG. 2, the Steering Voltage Generator 80 accepts the left and right input signals L and R which are fed through high pass filters 82L and 82R, respectively. These filters are shown and described in FIG. 4 of my U.S. Pat. No. 5,319,713, herein incorporated by reference. The filtered signals are then fed to level detectors 83L and 83R, which are the equivalent of those provided by the RSP 2060 IC available from Rocktron Corporation of Rochester Hills, Mich., All detectors shown in FIG. 2 are equivalent to those provided by the RSP 2060 IC, although other forms of level detection can be implemented, such as peak averaging, RMS detection, etc. The detected signals are buffered through buffer amplifiers 84L and 84R before being applied to a difference amplifier 85.

Predominant right high band information detected will result in a positive-going output from the difference amplifier 85. This positive-going output is fed through a VCA 118A and a diode 87R to a Time Constant Generator 88R. A positive voltage applied to the Time Constant Generator 88R will produce a positive voltage that is stored by a capacitor 88B. Therefore, the attack time constant is extremely fast, as a positive voltage applied from the output of the amplifier 85 will produce an instantaneous charge current for the capacitor 88B. The release characteristics of the Time Constant Generator 88R are produced by the capacitor 88B and a resistor 88A. The resistor 88A will be the only to discharge path for the capacitor 88B. The voltage on the capacitor 88B is buffered by an amplifier 88C, which then provides the Right Rear High band Voltage output signal $R_{RHV}$ fed to the Surround Steering Circuit 130 illustrated in greater detail in FIG. 7. All Time Constant Generators shown in FIG. 2 operate identically to the Time Constant Generator 88R above described.

Conversely, predominant left high band information will result in a negative-going output from the amplifier 85. This negative-going output is fed through the VCA 118A before being inverted by an inverting amplifier 86, producing a positive-going output through a diode 87L and a Time Constant Generator 88L to provide the Left Rear High band Voltage output signal $L_{RHV}$ fed to the Surround Steering Circuit 130.

The L and R input signals applied to the Steering Voltage Generator 80 are also fed through low pass filters 90L and 90R, respectively, before level detection is derived by detectors 91L and 91R. The detected signals are buffered through operational amplifiers 92L and 92R before being applied to a difference amplifier 93. Predominant right low band information detected will result in a positive-going output from the difference amplifier 93. This positive-going output is then fed through a VCA 118B and a diode 95R to a Time Constant Generator 96R, to provide the Right Rear Low band Voltage output signal $R_{RLV}$ fed to the Surround Steering Circuit 130.

Conversely, predominant left low band information will result in a negative-going output from the amplifier 93. This negative-going output is fed through the VCA 118B and inverted by an inverting amplifier 94, producing a positive-going output through a diode 95L and a Time Constant Generator 96L to provide the Left Rear Low band Voltage output signal $L_{RLV}$ fed to the Surround Steering Circuit 130.

In addition, the L and R input signals applied to the Steering Voltage Generator 80 are broadband level detected through detectors 98L and 98R, respectively. The detected signals are then buffered through operational amplifiers 99L and 99R before being applied to a difference amplifier 100. Predominant left information detected will cause the amplifier 100 to provide a negative-going signal which is fed to an inverting amplifier 101. The positive output from amplifier the 101 is fed through a diode 102L to a Time Constant Generator 103L, which produces a positive-going voltage at the output of the Time Constant Generator 103L. Conversely, if predominant right information is detected, the output of the difference amplifier 100 provides a positive-going signal which feeds a diode 102R and a Time Constant Generator 103R. The outputs of both Time Constant Generators 103L and 103R are fed to a summing amplifier 104 so that an output voltage $L/R_V$ will be derived from either a predominant left or right signal. This output voltage $L/R_V$ is then fed to the Surround Steering Circuit 130, a Center Steering Circuit 120, and an Overhead Steering Circuit 150.

The Steering Voltage Generator 80 also accepts an L+R input signal as well as an L−R input signal. These input signals are level detected through detectors 107F and 107B, respectively, and buffered through amplifiers 108F and 108B. The buffered signals are then applied to a difference amplifier 109. Predominant L+R information detected will produce a positive-going voltage at the output of the amplifier 109 to a Time Constant Generator 112F. An operational amplifier 113 inverts this signal to a negative-going voltage which is then used to control the steering VCAs in the Left Steering Circuit 40, shown in greater detail in FIG. 5L and the Right Steering Circuit 60 shown in greater detail in FIG. 5R. The amplifier 113 is configured as a unity gain inverting amplifier which has an additional resistor 115 applied between its "−" input and the negative supply voltage to provide a positive offset voltage at the output of another amplifier 113. In a quiescent condition, in which no front L+R or L−R information is present, the amplifier 113 will always provide a specified positive offset voltage so that, when applied to the Left Steering Circuit 40 and the Right Steering Circuit 60, it provides the proper voltage to attenuate the steering VCAs in those circuits. Therefore, a positive voltage is always applied at the $F_V$ output unless front information is detected. When front L+R information is detected, the output of the amplifier 113 will begin going negative from the positive offset voltage that was present prior to detecting the presence of the front L+R information. A strong presence of L+R information will cause the output of the amplifier 113 to go negative enough to cross 0 volts. When the output of the amplifier 113 crosses 0 volts, a diode 117 becomes reverse biased and provides zero output voltage at the $F_V$ output. Predominant L−R surround information detected will produce a negative-going voltage at the output of the difference amplifier 109. This negative-going voltage is inverted by an inverting amplifier 110 and therefore produces a positive output from a Time Constant Generator 112B to provide the $B_V$ output which controls steering VCAs in the Left Steering Circuit 40 and the Right Steering Circuit 60.

The signal $B_V$ is also fed to a Threshold Detect circuit 119, which feeds the control ports of the Voltage Controlled Amplifiers 118A and 118B. Under hard surround-panned conditions, the VCAs 118A and 118B dynamically increase the gain of the output of their input amplifiers 85 and 93, respectively, up to a gain of 10. The VCAs 118A and 118B provide gain only when signals are panned exclusively to surround positions, and otherwise provide unity gain output under all other conditions. The Threshold Detect circuit 119 monitors the level of the signal $B_V$ to determine when the VCAs 118A and 118B are active, and to what degree they increase the output of the amplifiers 85 and 93. When a strong surround signal L−R is detected, the signal $B_V$ will exceed 2 volts. As $B_V$ exceeds 2 volts, the Threshold Detect circuit 119 applies a positive voltage to the control ports of the VCAs 118A and 118B, thus increasing the gain output from their import amplifiers 85 and 93, respectively. When $B_V$ is at 2 volts, the gain factor of the VCAs 118A and 118B is very low. However, as the $B_V$ signal level increases, stronger L−R information being detected at the input and approaches 3 volts, the gains of the VCAs 118A and 118B increase proportionately. When the signal $B_V$ reaches 3 volts, the gains of the VCAs 118A and 118B reach a maximum gain factor of 10.

The high and low band level detectors 83L, 83R, 91L and 91R provide a response of one volt per 10 dB change in input balance. For ease of explanation, the VCAs 139, 140, 141 and 142 all shown in FIG. 7, can also be configured to provide a 1 volt/10 dB response. Therefore, if a hard surround L−R signal is detected at the input with the L information at unity gain and the −R information at −3 dB, a 3 dB left dominance will be detected and the output of the high and low band amplifiers 85 and 93 will each be −0.3 volts. Because the input is panned hard-surround, causing the signal $B_V$ to reach 3 volts, this −0.3 volts will be amplified by a factor of 10 by the VCAs 118A and 118B, thereby producing a $L_{RHV}$ and $L_{RLV}$ of 3 volts. These 3 volt signals are then applied to the VCAs 139 and 141, shown in FIG. 7, respectively, which will steer the respective left rear output by 30 dB.

Figure 3:
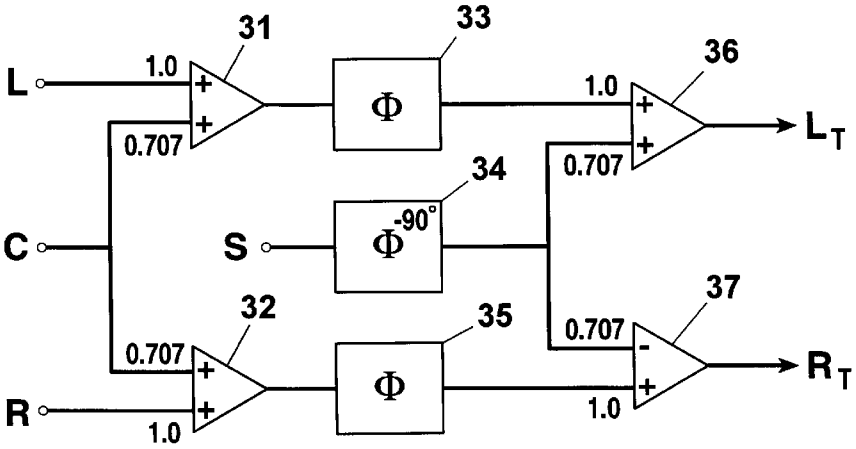
Fig. 3 (PRIOR ART)
FIG. 3 is a block diagram of a prior art encoding method.

Referring to FIG. 3, a block diagram of a typical prior art encoding scheme is disclosed, wherein four discrete signals, left, right, center and surround, are encoded down to a two-channel stereo signal. A left input signal L is fed to a summing amplifier 31, while a right input signal R is fed to another summing amplifier 32. A center channel input C is fed equally to the summing amplifiers 31 and 32 at −3 dB. The output of the first amplifier 31 is fed to an all-pass network 33, which provides a linear phase vs. frequency response. The output of the all-pass network 33 is then fed to a third summing amplifier 36. The output of the second amplifier 32 is fed to another all-pass network 35, which is similar to the first all-pass network 33 and also provides a linear phase vs. frequency response. The output of the second all-pass network 35 is then fed to a fourth summing amplifier 37. A surround input signal S is fed directly to a third all-pass network 34, which provides a 90° phase shift and a linear phase vs. frequency response. The output of the third all-pass network 34 is fed equally to the third and fourth summing amplifiers 36 and 37 at −3 dB. It also must be noted that the output of the third all pass network 34 is fed to the inverting input of the fourth summing amplifier 37, so as to avoid any cancellation of the $R_T$ signal. The third and fourth amplifiers 36 and 37 provide the left and right encoded outputs $L_T$ and $R_T$.

Figure 4:
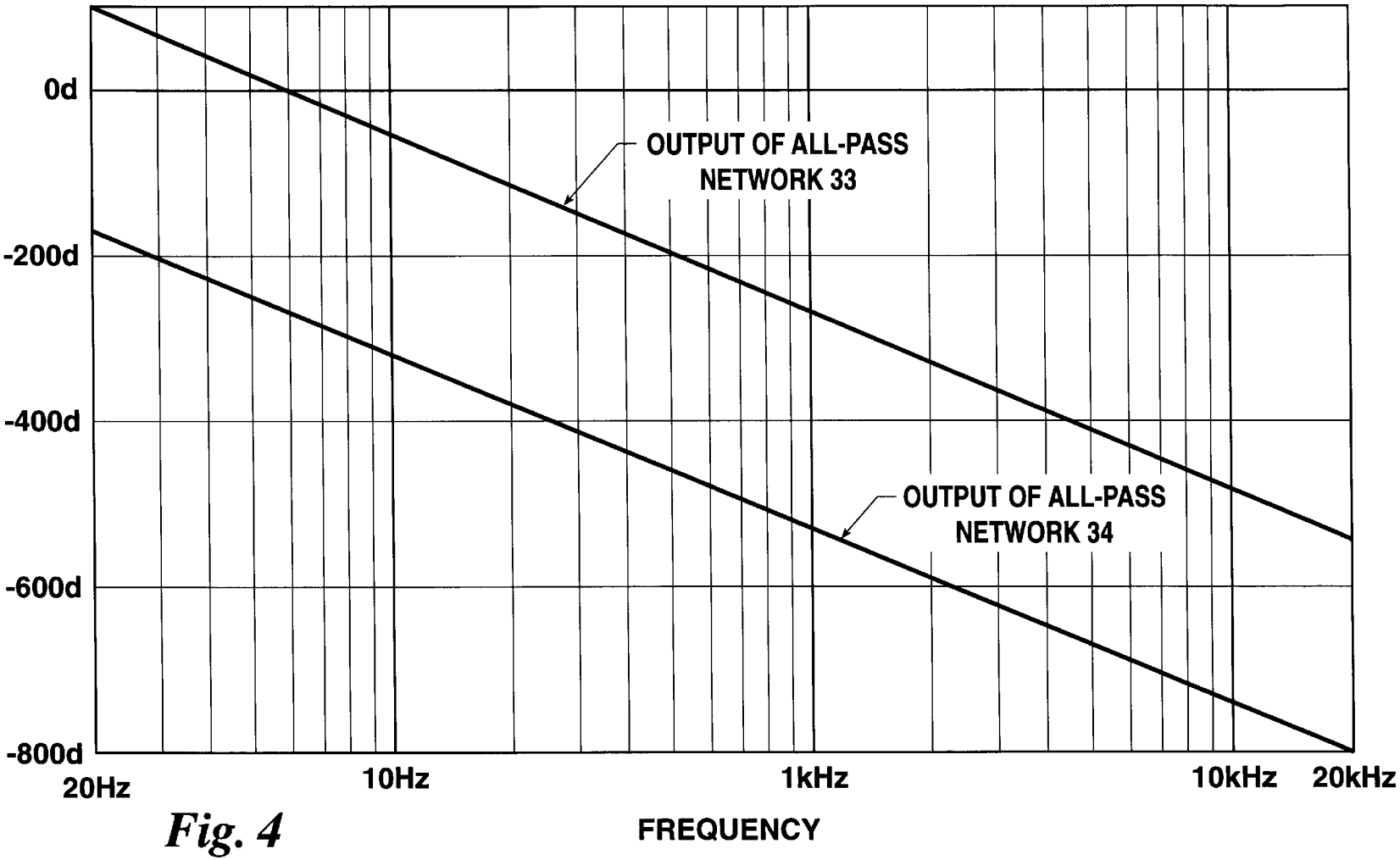
FIG. 4 is a phase vs. frequency graph of the outputs of the all-pass networks of FIG. 3.

FIG. 4 is a phase vs. frequency graph which illustrates the relationship between the outputs of the first and third all-pass networks 33 and 34 over the entire audio spectrum. It can be seen that, at any given frequency, the output of the third all-pass network 34 is always approximately 90° out of phase with the output of the first all-pass network 33.

Figure 5:
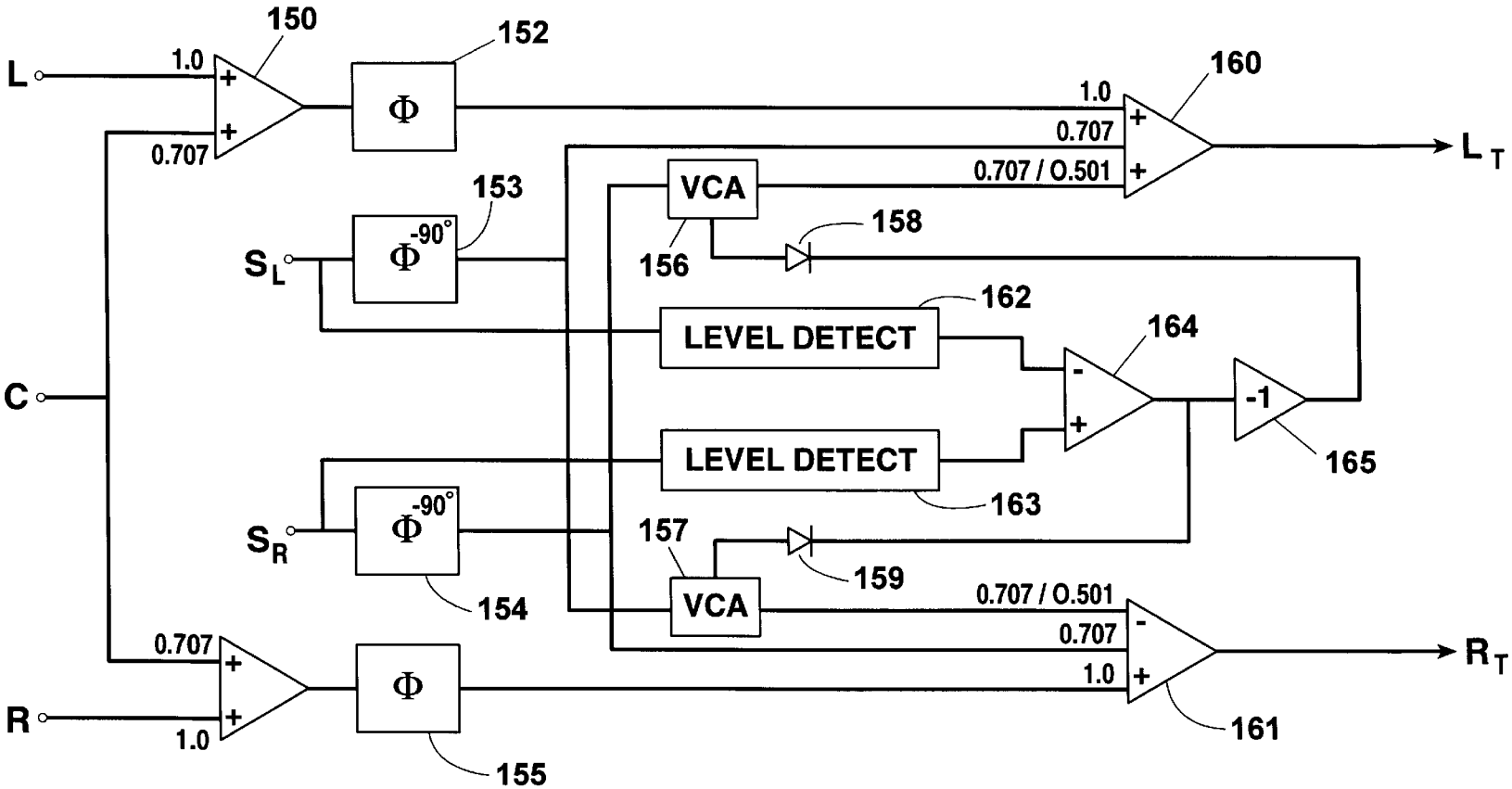
FIG. 5 is a block diagram of the encoding method implemented for the present invention.

FIG. 5 discloses a system which accepts five discrete signals and encodes them down to a two-channel stereo signal. A left input signal L is fed to a summing amplifier 150, while a right input signal R is fed to a second summing amplifier 151. A center channel input C is fed equally to the summing amplifiers 150 and 151 at −3 dB. The output of the first amplifier 150 is fed to an all-pass network 152, which provides a linear phase vs. frequency response. The output of the all-pass network 152 is then fed to a third summing amplifier 160. The output of the second summing amplifier 151 is fed to a second all-pass network 155, which is similar to the first all-pass network 152 and also provides a linear phase vs. frequency response. The output of the second all-pass network 155 is then fed to a fourth summing amplifier 161. A left surround input signal $S_L$ is fed directly to a third all-pass network 153, which provides a 90° phase shift and a linear phase vs. frequency response. The output of the third all-pass network 153 is fed to the third summing amplifier 160 at −3 dB and a VCA 157, which feeds the fourth amplifier 161. A right surround input signal $S_R$ is fed directly to a fourth all-pass network 154, which provides a 90° phase shift and a linear phase vs. frequency response. The output of the fourth all-pass network 154 is fed to the fourth summing amplifier 161 at −3 dB and another VCA 156, which feeds the third amplifier 160. The left surround input signal $S_L$ is also fed to a level detection circuit 162. Likewise, the right surround input $S_R$ is also fed to another level detection circuit 163. The outputs of the detectors 162 and 163 are summed at a fifth amplifier 164. The output of the fifth amplifier 164 feeds a diode 159 before being applied to the control port of another first VCA 157. The output of the fifth amplifier 164 is also inverted by a sixth amplifier 165 before feeding another diode 158 and being applied to the control port of the second VCA 156. In a quiescent condition the VCAs 156 and 157 each provide an output of −3 dB. The third and fourth amplifiers 160 and 161 provide the left and right encoded outputs $L_T$ and $R_T$.

In this configuration, a strong left surround signal $S_L$ will be detected by the first detector 162 and inverted through the fifth amplifier 164. The negative-going output from the fifth amplifier 164 is applied to the first VCA 157, causing it to attenuate the output of the first VCA 157 an additional 3 dB. The negative-going output from the fifth amplifier 164 is also inverted through the sixth amplifier 165. Due to reverse-biased second diode 158, no voltage is applied to the control port of the second VCA 156. Therefore, the output of the second VCA 156 remains −3 dB, and the left surround signal $S_L$ is encoded 3 dB higher than the right surround signal $S_R$. Conversely, a strong right surround signal SR detected by the second detector 163 will produce a positive-going output from the fifth amplifier 164. This positive-going output is inverted through the sixth amplifier 165, and fed through the second diode 158 to the control port of the second VCA 156 to attenuate the output of the second VCA 156 an additional 3 dB. Due to reverse-biased first diode 159, the positive-going voltage is not applied to the control port of the first VCA 157. Therefore, the output of the first VCA 157 remains −3 dB, and the right surround signal $S_R$ is encoded 3 dB higher than the left surround signal $S_L$. This technique allows for the encoding of a L−R signal where L is slightly hotter than −R, and can intentionally be steered specifically to the left rear with all of the other channels steered down. Likewise, an independent right surround signal can be realized by encoding the −R signal at unity gain while encoding the L signal at −3 dB. Thus, a 5-2-5 matrixing system can be achieved which allows any encoded signal can be fed exclusively to the front left, front right, center, rear left or rear right channels.

Figure 6L:
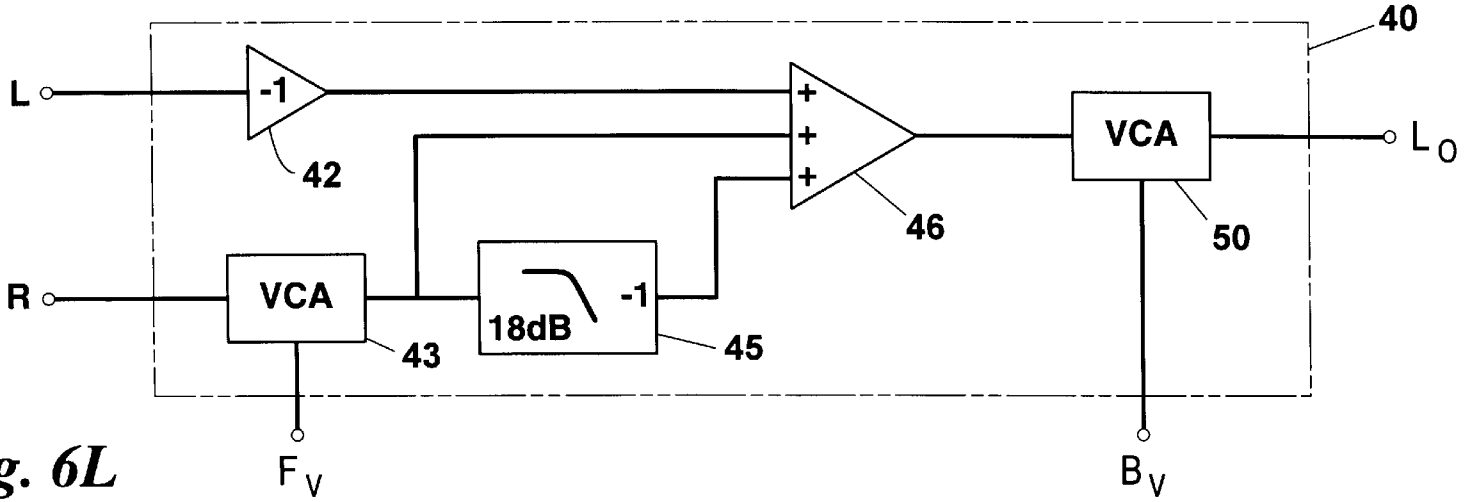
FIG. 6L is a partial block/partial schematic diagram of Left Steering Circuit of FIG. 2.

Now referring to FIG. 6L, L and R input signals are applied to the Left Steering Circuit 40. The input signal L is inverted through an amplifier 42 and fed to a summing network 46. The R input signal is fed through a VCA 43 before being fed to the summing network 46. VCAs are commonly known and used in the art, and any skilled artisan will understand how to implement a Voltage Controlled Amplifier which will provide the proper functions for all of the Voltage Controlled Amplifiers demonstrated in the present invention. The VCA 43 is controlled by the signal $F_V$ applied at its control port. The output of the VCA 43 is fed to the input of an 18 dB/octave inverting low pass filter 45. Anyone skilled in the art will understand how to design and implement such a filter network. The output of the filter 45 is also fed to the summing network 46. When the output of the filter 45 is summed with the output of the VCA 43, all of the low band information below the corner frequency of the filter 45 is subtracted. In practice, this corner frequency is typically 200 Hz. When the outputs of the amplifier 42, the VCA 43 and the low pass filter 45 are summed at the summing network 46, the output of the summing network 46 will contain the difference between the left and right inputs. However, the low band information below the corner frequency of the low pass filter 45 is not affected, and therefore appears at the output. This process allows for the removal of center channel information from the left output $L_O$ signal. As the signal FV applied to the control port of the VCA 43 goes positive, the output of the VCA 43 attenuates and less cancellation of the center signal L+R occurs. Therefore, it can be seen that, in a quiescent condition, the signal $F_V$ applied at the control port of the VCA 43 is positive and no attenuation takes place. As center channel information L+R is detected by the Steering Voltage Generator 80, the signal $F_V$ will go negative, eventually reaching 0 volts, and will result in the total removal of the center channel signal from the left output $L_O$.

The output of the summing amplifier 46 is then fed to a second VCA 50 which provides the left output signal $L_O$. The second VCA 50 is controlled by the signal $B_V$ derived in FIG. 2. L−R information detected at the input will produce a positive-going voltage which will result in attenuation in the second VCA 50. This allows strong surround information L−R to be attenuated in the left front output signal $L_O$ such that a hard surround signal applied during the encoding process is totally eliminated in the left front and will only appear at the respective rear surround channel.

Figure 6R:
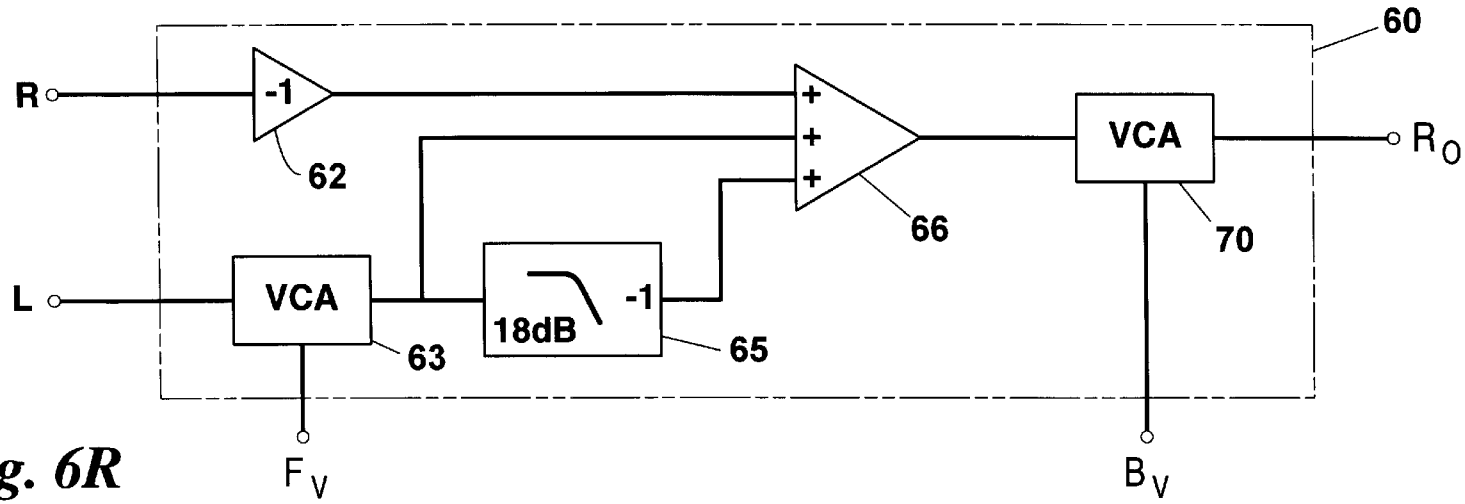
FIG. 6R is a partial block/partial schematic diagram of Right Steering Circuit of FIG. 2.

FIG. 6R discloses the Right Steering Circuit 60. The Right Steering Circuit 60 operates identically to the Left Steering Circuit 40 to provide the Right output signal $R_O$ with the exception that the input signals L and R are reversed.

Figure 7:
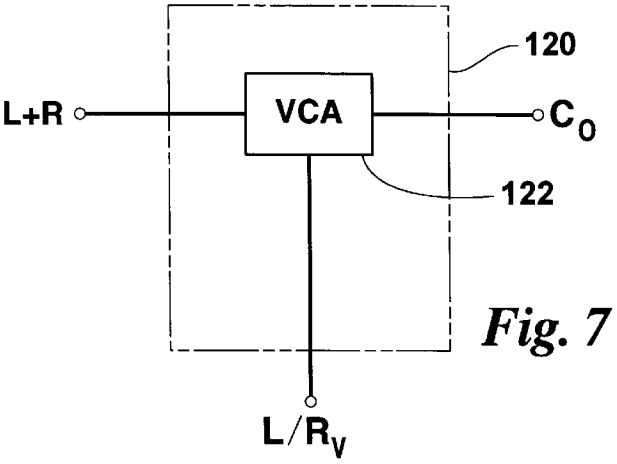
FIG. 7 is a partial block/partial schematic diagram of Center Steering Circuit of FIG. 2.

Referring to FIG. 7, a Left+Right signal (L+R) is input to the Center Steering Circuit 120. This input signal is fed through a VCA 122 to provide the center channel output $C_O$ of the Center Steering Circuit 120. The VCA 122 is controlled by the $L/R_V$ signal from the Steering Voltage Generator 80. It becomes apparent that left or right broadband panning will cause the VCA 122 to attenuate the center output $C_O$, as broadband left or right panning will produce a positive-going URv signal into the control port of the VCA 122.

Figure 8:
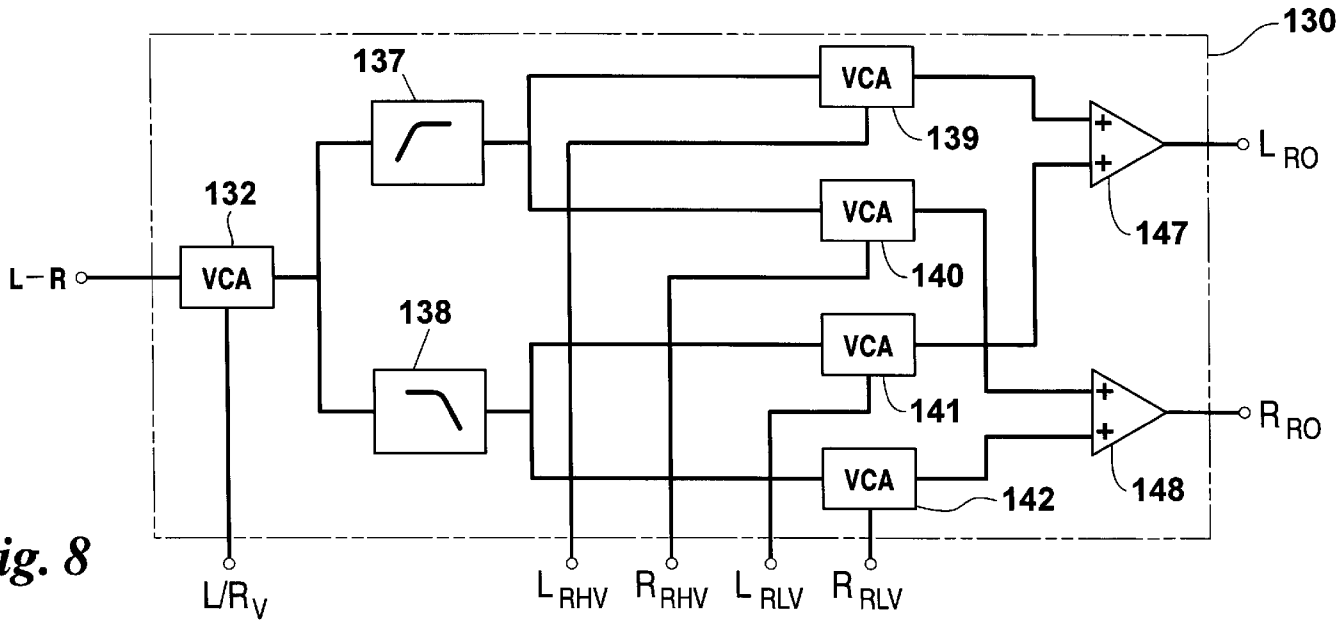
FIG. 8 is a partial block/partial schematic diagram of Surround Steering Circuit of FIG. 2.

Referring to FIG. 8, the Surround Steering Circuit 130 accepts the L−R signal at its input and applies it to the input of a VCA 132, which is controlled by the $L/R_V$ signal from the Steering Voltage Generator 80. The system is configured such that only extreme hard left or hard right broadband panning causes the VCA 132 to attenuate, so that full left/right directional information remains present under typical stereo conditions. The output of the VCA 132 is applied to a high pass filter 137, which produces high band output to two drive steering VCAs 139 and 140. The output of the VCA 132 is also applied to a low pass filter 138, which produces a low band output to two more drive steering VCAs 141 and 142. The filters 137 and 138 are clearly disclosed and described in my previously cited '713 patent as High Pass Filter 31 and Low Pass Filter 32. The high band output from the first steering VCA 139 is summed with low band output from the third steering VCA 141 at a summing amplifier 147. The summation of these two signals provides the Left Rear Output signal $L_{RO}$ applied to the left rear channel. Similarly, the high band output from the second steering VCA 140 is summed with the low band output from the fourth steering VCA 142 to provide the Right Rear Output signal $R_{RO}$ fed to the right rear channel. Steering voltages $L_{RHV}$, $R_{RHV}$, $L_{RLV}$ and $R_{RLV}$ applied to the control ports of the steering VCAs 139, 140, 141 and 142, respectively, control the left and right rear or surround steering. The basic operation of multiband steering is described in my U.S. Pat. No. 5,319,713.

Thus, it is apparent that there has been provided, in accordance with the invention, a 5-2-5 matrix system that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For use in an audio system encoding five discrete input signals into two-channel stereo, a process comprising the steps of:

applying a first of the input signals to an input of a variable multiplier;

combining the first and a second of the input signals to provide a control signal indicative of a ratio of the first and second input signals;

applying the control signal to the variable multiplier to vary the gain applied to the first input signal;

combining a third and a fourth of the input signals to produce a composite signal; and combining an output signal of the variable multiplier with the second of the input signals and the composite signal to produce an output signal of the two channel stereo.

2. For use in an audio system encoding five discrete input signals into two-channel stereo, a process comprising the steps of:

applying a first of the input signals to an input of a first variable multiplier;

applying a second of the input signals to an input of a second variable multiplier;

combining the first and second input signals to provide a control signal indicative of a ratio of the first and second input signals;

applying the control signal to the first variable multiplier to vary the gain applied to the first input signal;

combining a third and a fourth of the input signals to produce a first composite signal; and combining an output signal of the first variable multiplier with the second of the input signals and the first composite signal to produce a first output signal of the two channel stereo.

3. For use in an audio system encoding five discrete input signals into two-channel stereo, a process comprising the steps of:

applying a first of the input signals to an input of a first variable multiplier;

applying a second of the input signals to an input of a second variable multiplier;

combining the first and second input signals to provide a first control signal indicative of a ratio of the first and second input signals;

applying the control signal to the first variable multiplier to vary the gain applied to the first input signal;

inverting the first control signal to provide a second control signal;

applying the second control signal to the second variable multiplier to vary the gain applied to the second input signal;

combining a third and a fourth of the input signals to produce a first composite signal;

combining an output signal of the first variable multiplier with the second of the input signals and the first composite signal to produce a first output signal of the two channel stereo;

combining the fourth and a fifth of the input signals to produce a second composite signal; and combining an output signal of the second variable multiplier with the first of the input signals and the second composite signal to produce a second output signal of the two channel stereo.

* * * * *